United States Patent [19]

Riehl

[11] 3,972,219

[45] Aug. 3, 1976

[54] APPARATUS FOR MAKING THE INLET END OF A TUBULAR BURNER CONSTRUCTION

[75] Inventor: Fred Riehl, Greensburg, Pa.

[73] Assignee: Robertshaw Controls Company, Richmond, Va.

[22] Filed: Jan. 15, 1975

[21] Appl. No.: 541,154

Related U.S. Application Data

[62] Division of Ser. No. 412,103, Nov. 2, 1973, Pat. No. 3,874,839.

[52] U.S. Cl. ..... 72/416; 72/367; 72/470

[51] Int. Cl.[2] ..... B21D 7/00

[58] Field of Search ..... 72/415, 416, 470, 335, 72/410, 367, 369; 29/516, 517

[56] References Cited

UNITED STATES PATENTS

| | | | |
|---|---|---|---|
| 1,891,785 | 12/1932 | Siebert | 72/367 |
| 2,799,533 | 7/1957 | Bachli | 29/516 |
| 2,972,781 | 2/1961 | Levy | 29/517 |

*Primary Examiner*—Lowell A. Larson
*Assistant Examiner*—Gene P. Crosby
*Attorney, Agent, or Firm*—Candor, Candor & Tassone

[57] ABSTRACT

Cooperating die structure is disclosed for making the inlet end of a tubular burner construction. The inlet end is shaped by using a pair of dies which form a pair of spaced gripping parts respectively interconnected together at opposed ends thereof by substantially C-shaped resilient parts.

2 Claims, 9 Drawing Figures

APPARATUS FOR MAKING THE INLET END OF A TUBULAR BURNER CONSTRUCTION

This application is a division of application Ser. No. 412,103 filed Nov. 2, 1973 now U.S. Pat. No. 3,874,839.

This invention relates to an improved burner construction as well as to an improved method and apparatus for making such a burner construction or the like.

It is well known that tubular burner constructions have been provided wherein each burner construction has an inlet end provided with a Venturi sleeve or the like for not only permitting air to be entrained in the fuel flowing into the inlet means of the burner construction, but also to provide structure for telescoping onto a fuel supply member, such as an orifice cup, to support the inlet end of the burner construction.

However, it has been found according to the teachings of this invention, that when such prior known burner construction arrangement is utilized in mobile homes and the like, the vibrations of the traveling vehicle cause the burner construction to vibrate and thereby rattle against the orifice cup and cause an adverse noise problem.

Accordingly, it is a feature of this invention to provide an improved burner construction wherein the aforementioned rattling problem is substantially eliminated.

In particular, one embodiment of the burner construction of this invention comprises a one-piece tubular member having port means in the side wall thereof to interconnect with the fuel receiving chamber therein. One end of the burner construction comprises an inlet means therefor and is adapted to be attached to a fuel supply member in a telescoping manner therewith, the inlet means having gripping means for continuously, resiliently gripping the fuel supply member to prevent rattling therebetween. The gripping means can comprise opposed sides of the inlet end of the tubular burner construction that are bent out of the normal configuration thereof to define gripping structure, the bent out opposed sides being carved from the one end of the tubular member to also define air entrance means for supplying air into the chamber of the burner construction as fuel is fed thereto.

Accordingly, it is an object of this invention to provide an improved burner construction having one or more of the novel features set forth above or hereinafter shown or described.

Another object of this invention is to provide an improved method of making such a burner construction or the like.

Another object of this invention is to provide an improved apparatus for making such a burner construction or the like.

Another object of this invention is to provide an improved combination of a burner construction and a fuel supply member attached thereto.

Other objects, uses and advantages of this invention are apparent from a reading of this description which proceeds with reference to the accompanying drawings forming a part thereof and wherein.

Figure 1:
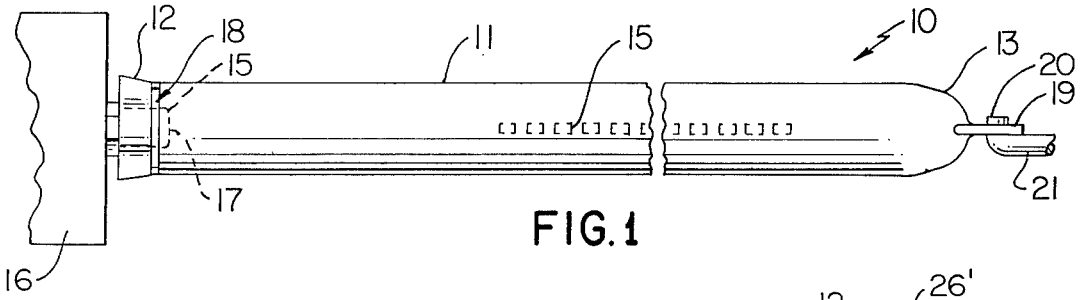
FIG. 1 is a side view illustrating the improved burner construction of this invention attached to a fuel supply member.
Figure 2:
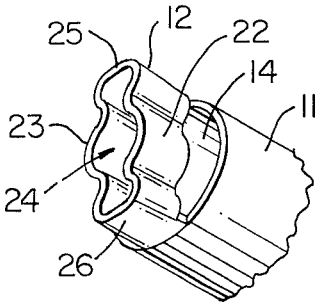
FIG. 2 is a fragmentary perspective view of the inlet end of the burner construction of FIG. 1.

While the various features of this invention are hereinafter described and illustrated as being particularly adapted for forming a burner construction for a vehicle, it is to be understood that the various features of this invention can be utilized singly or in any combination thereof to provide a burner construction for other uses as desired.

Therefore, this invention is not to be limited to only the embodiment illustrated in the drawings, because the drawings are merely utilized to illustrate one of the wide variety of uses of this invention.

Referring now to FIG. 1, the improved burner construction of this invention is generally indicated by the reference numeral 10 and comprises a tubular member 11 having an inlet end 12 and an opposed closed end 13 whereby fuel is adapted to enter the inlet end 12 of the burner construction 10 and flow through a tubular chamber 14 thereof to be issued out of suitably formed ports 15 formed in the side wall of the tubular member 11 in any desired pattern.

The inlet end 12 of the burner construction 10 is adapted to be telescoped onto a fuel supplying member 15 that comprises a cylindrically shaped orifice cup being fed fuel from a source of supply through a control device 16 that carries the orifice cup in a conventional manner whereby fuel is adapted to enter the chamber 14 of the burner construction 10 through a suitable orifice (not shown) in the end wall 17 of the orifice cup 15 and air will be drawn into the inlet end 12 of the burner construction 10 by the flow of fuel therein through air entrance means 18 formed in the burner construction 10 in a manner hereinafter described.

The closed end 13 of the burner construction 10 is provided with an outwardly directed flange 19 which has a suitable aperture formed therethrough to telescopically receive an upturned end 20 of a supporting member 21 whereby the burner construction 10 is adapted to be supported in the horizontal position illustrated in FIG. 1 solely by the support member 21 and the control device 16 for a heating or cooking operation, as desired.

As previously stated, prior known burner constructions each tended to rattle on the orifice cup 15 of the control device 16 because of the telescoping relation therewith.

However, according to the teachings of this invention, the inlet means 12 of the burner construction 10 is formed with a pair of opposed resilient gripping members 22 and 23 formed in a manner hereinafter described to define a generally cylindrically shaped opening 24 between medial portions thereof for telescopically receiving the orifice cup 15 therein, the parts 22 and 23 being interconnected at opposed ends thereof by generally C-shaped parts 25 and 26 which add resiliency to the gripping parts 22 and 23 so that when the orifice cup 15 is received in the opening 24, the parts 22 and 23 are forced outwardly through the telescoping fit with the orifice cup 15 so that the parts 22 and 23 are continuously urged toward each other by the C-shaped parts 25 and 26 and thereby continuously grip the orifice cup 15 therebetween in a resilient manner to prevent rattling therebetween. Thus, shocks and vibrations of a vehicle carrying the burner construction arrangement of FIG. 1 will not cause rattling between the tubular burner member 11 and the orifice cup 15 because the orifice cup 15 is being held between the medial parts of the spring members 22 and 23 that have a continuous bias toward each other when the orifice cup 15 is disposed between the same. Accordingly, no movement takes place between the gripping members 22 and 23 and the orifice cup 15.

The burner construction 10 is initially formed from a straight tubular one-piece member 11 which has its end 13 closed in any suitable manner and the inlet end 12 formed to produce the resilient gripping members 22 and 23 in the manner now to be described.

Figure 3:
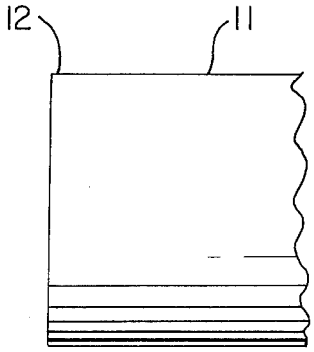
FIG. 3 is an enlarged fragmentary side view of the inlet end of the burner construction before the inlet means of this invention is formed.

As illustrated in FIG. 3, the tube 11 initially had the end 12 thereof uniform with the remainder of the tube 11.

Figure 4:
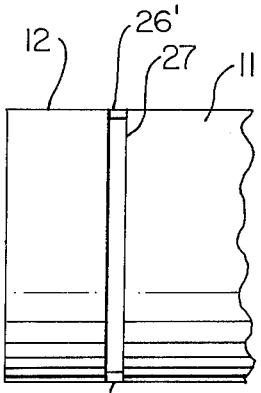
FIG. 4 is a view similar to FIG. 3 and illustrates one step in the method of forming the inlet means of the burner construction.
Figure 5:
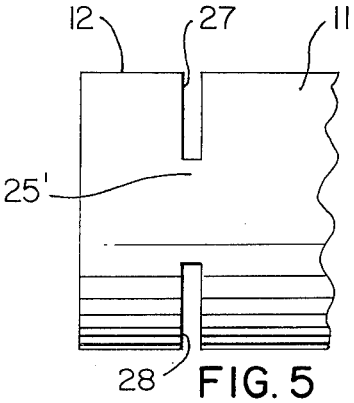
FIG. 5 is a view similar to FIG. 4 with the burner construction rotated 90°.

A pair of slots 27 and 28, FIGS. 4 and 5, are cut into opposed sides of the tubular member 11 at the inlet end 12 thereof with the integral segments 25' and 26' of the tube 11 separating the slots 27 and 28 from each other as illustrated in FIG. 5.

Figure 6:
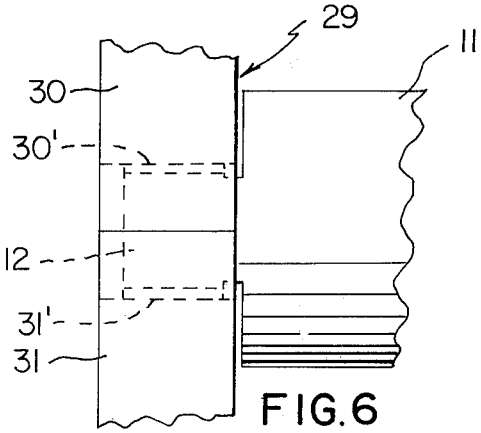
FIG. 6 is a fragmentary side view of the improved apparatus of this invention for forming the inlet means of the burner construction of FIG. 5.
Figure 7:
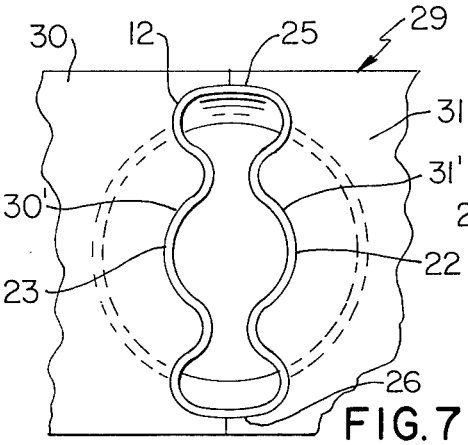
FIG. 7 is a left fragmentary side view of the apparatus of FIG. 6 and is rotated 90° from the position illustrated in FIG. 6.
Figure 8:
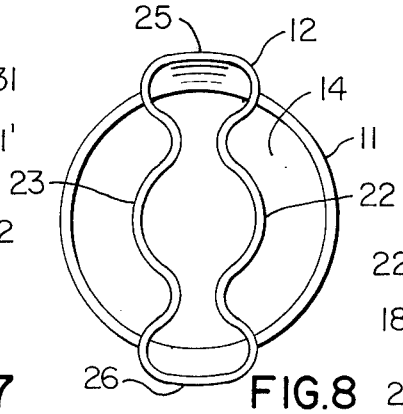
FIG. 8 is an enlarged rear view of the formed inlet means of the burner construction of FIG. 1.
Figure 9:
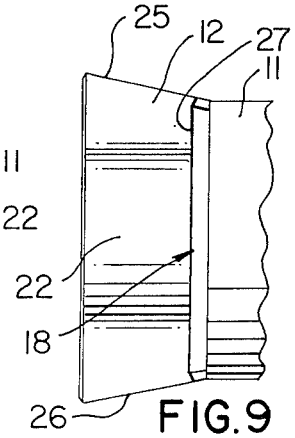
FIG. 9 is a fragmentary side view of the inlet means of the burner construction of FIG. 8.

The thus cut tube 11 is placed in an apparatus of this invention which is generally indicated by the reference numeral 29 in FIGS. 6 and 7 and includes a pair of forming die members 30 and 31 which are suitably shaped at the die forming surfaces 30' and 31' thereof so that when the die members 30 and 31 are brought together in the manner illustrated in FIGS. 6 and 7 with the end 12 of the tube 11 therebetween, the gripping members 22 and 23 and the resilient interconnectors 25 and 26 are formed into the configuration illustrated in FIGS. 7, 8 and 9 to provide the unique inlet means 12 of this invention for the purpose previously described. If desired, a suitably shaped mandrel can be disposed in the end 12 of the tube 11 to cooperate with the forming dies 30 and 31 during their forming operation on the end 12 of the tube 11.

Thus, it can be seen that the gripping members 22 and 23 are, in effect, carved from the tubular member 11 and are formed by the die members 30 and 31 to be spring members for the intended continuous gripping purpose and such carving operation of the cut slots 27 and 28 also provides the air entrance means 18 previously described when the gripping members 22 and 23 are formed.

In this manner, it can be seen that the burner construction 10 is a one-piece structure without requiring auxiliary parts for attaching the inlet end 12 to the fuel supply member 15 as in prior burner constructions and the burner construction 10 of this invention has the unique feature of being anti-rattle at the inlet end 12 thereof due to the continuous resilient gripping of the members 22 and 23 against the orifice cup 15 as previously described.

Therefore, it can be seen that this invention not only provides an improved burner construction and arrangement, but also this invention provides an improved method and apparatus for making such a burner construction or the like.

While the form and method of this invention now preferred has been illustrated and described as required by the Patent Statute, it is to be understood that other forms and methods can be utilized and still come within the scope of the appended claims.

I claim:

1. An apparatus for making the inlet end of a tubular burner construction comprising a pair of cooperating die members each having a die surface means for engaging the cylindrical end of said tubular burner construction and forming said cylindrical end into a pair of spaced gripping means respectively interconnected together at opposed ends thereof by substantially C-shaped resilient parts, said surface means forming said gripping means and said C-shaped parts to have arcuate portions disposed in two planes that are spaced from each other and are generally parallel to each other when said die members are moved toward each other a certain amount.

2. An apparatus as set forth in claim 1 wherein said die members have parts thereof that engage each other when said die members are brought together said certain amount to form said inlet end of said burner construction, said parts of said die members being outboard of said die surfaces.

* * * * *